US006327453B1

(12) United States Patent
Imaizumi et al.

(10) Patent No.: US 6,327,453 B1
(45) Date of Patent: Dec. 4, 2001

(54) IMAGE FORMING APPARATUS AND REGISTRATION CORRECTION METHOD TO CORRECT DISLOCATION OF FORMED IMAGES

(75) Inventors: Shoji Imaizumi, Shinshiro; Hiroyuki Ideyama, Toyokawa; Takatsugu Kuno, Aichi-Ken; Kazuyuki Kawabata, Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/536,617

(22) Filed: Mar. 28, 2000

(30) Foreign Application Priority Data

Mar. 31, 1999 (JP) ..... 11-092463

(51) Int. Cl.[7] ..... G03G 15/01
(52) U.S. Cl. ..... 399/301; 399/43; 399/49
(58) Field of Search ..... 399/301, 38, 39, 399/40, 43, 44, 49, 298, 299, 300, 306; 347/116; 358/526

(56) References Cited

U.S. PATENT DOCUMENTS 5,105,219 * 4/1992 Yoshikado ..... 399/43 X
5,452,073 * 9/1995 Kataoka ..... 399/299
5,548,378 * 8/1996 Ogata et al. ..... 399/44 X
5,550,625 * 8/1996 Takamatsu et al. ..... 399/301
5,715,498 * 2/1998 Takeuchi et al. ..... 399/301 X
5,778,280 * 7/1998 Komiya et al. ..... 399/49
5,966,557 * 10/1999 Wada ..... 399/43

FOREIGN PATENT DOCUMENTS 10-282763 10/1998 (JP) .
10-282857 10/1998 (JP) .

* cited by examiner

*Primary Examiner*—Arthur T. Grimley
*Assistant Examiner*—Hoan Tran
(74) *Attorney, Agent, or Firm*—McDermott, Will & Emery

(57) ABSTRACT

An image forming apparatus with a plurality of image forming units for forming an input image on a recording medium, a fixing unit for fusing the image formed on the recording medium to the recording medium, a fixing temperature detecting unit for detecting the temperature of the fixing unit, a registration pattern detecting unit for detecting a registration pattern formed by a plurality of image forming units, a calculator for determining a registration correction value for correcting the input image based on output from the registration pattern detecting unit, and an update requesting unit for requesting an update of the registration correction value. The update requesting unit requests an update of the registration correction value based on the temperature detected temperature of the fixing unit.

12 Claims, 9 Drawing Sheets

IMAGE FORMING APPARATUS AND REGISTRATION CORRECTION METHOD TO CORRECT DISLOCATION OF FORMED IMAGES

BACKGROUND OF THE INVENTION

FIELD OF THE INVENTION

The present invention relates to an image forming apparatus, and specifically relates to an image forming apparatus having a plurality of image forming units, and which performs a registration correction process to correct dislocation of images formed by the plurality of image forming units.

DESCRIPTION OF THE RELATED ART

Digital copiers are known which form full color images by supporting a recording medium used for image formation on an endless belt, and sequentially forming images with toner of different colors as the recording medium is transported. Such a digital copier forms images using toners of four colors, i.e., cyan (C), magenta (M), yellow (Y), black (K), and is provided with image forming units for forming images in each of the colors. An image of each color is formed as the recording medium passes the image forming units, such that images of four colors are overlaid by passing four image forming units.

Since the full color image is formed by overlaying images of four colors formed by four image forming units, it is necessary to prevent dislocation of the four overlaid images. For this reason, the amount of dislocation of registration patterns actually formed on an endless belt by the respective four image forming unit is detected, and a registration correction value for correcting the images is determined based on the detected dislocation. Then, the image is subjected to a registration correction process based on this determined registration correction value.

The registration pattern has a shape determined beforehand, and is formed on an endless belt by the four image forming units. The amount of dislocation of the registration pattern actually formed on the endless belt is detected by reading the registration pattern formed on the endless belt.

The registration correction value used in the registration correction process is updated at predetermined time intervals, or when a predetermined number of images have been formed in the color image forming mode.

The registration correction value update process requires a predetermined amount of time for execution since the registration pattern is actually formed on the endless belt by the four image forming units. Accordingly, when the registration correction value update process is executed at predetermined time intervals, this registration correction value update process may be executed while the digital copier is being used. In this instance, the user must wait until the registration correction value update process is completed, thereby lengthening the time necessary for the copy operation and adversely affecting efficiency. Furthermore, when the registration correction value update process is executed after a predetermined number of images have been formed in the color image forming mode, the user must similarly wait until the registration correction value update process is completed, thereby lengthening the time necessary for the copy operation.

When the amount of residual toner is low, the registration correction value cannot be accurately determined because the registration pattern is not reliably formed by the image forming units.

DISCLOSURE OF THE INVENTION

An object of the present invention is to eliminate the previously described disadvantages by providing an image forming apparatus capable of reducing the time required for copying in an image forming apparatus which performs a registration correction process.

Another object of the present invention is to provide an image forming apparatus capable of reliably performing a registration correction process.

These objects are attained by an aspect of the image forming apparatus of the present invention comprising: a plurality of image forming units for respectively forming images on a recording medium; a fixing unit for fusing the images formed on the recording medium to the recording medium; a fixing temperature detecting unit for detecting a temperature of the fixing unit; a registration pattern detecting unit for detecting registration patterns formed by the plurality of image forming units; and a calculating unit connected with the registration pattern detecting unit and the image forming units, said calculating unit determining registration correction values for correcting deviance of the images based on output from the registration pattern detecting unit and requesting an update of the registration correction values based on the temperature detected by the fixing temperature detecting unit.

It is desirable that the update request means of the image forming apparatus requests the registration correction value update when the temperature detected by the fixing temperature detecting means is less than a predetermined value.

Another aspect of the image forming apparatus of the present invention comprises: a plurality of image forming units for respectively forming images on a recording medium; a receiving unit for receiving input from outside the apparatus; a registration pattern detecting unit for detecting registration patterns formed by the plurality of image forming units; and a calculating unit including a first timer for measuring the passage of time from the reception of final input by the receiving unit and a second timer for measuring the passage of time from the point the plurality of image forming units stop, said calculating unit being connected with the registration pattern detecting unit and the plurality of image forming unit, said calculating unit determining a registration correction values for correcting deviance of the images based on an output from the registration pattern detecting unit and requesting an update of the registration correction values based on a value of the first timer and/or the second timer.

Another aspect of the image forming apparatus of the present invention comprises: a plurality of image forming units for respectively forming images on a recording medium; a fixing unit for fusing the images formed on the recording medium to the recording medium; a fixing temperature detecting unit for detecting a temperature of the fixing unit; a registration pattern detecting unit for detecting registration patterns formed by the plurality of image forming units; a receiving unit for receiving input from outside the apparatus; and a calculating unit including a first timer for measuring the passage of time from the reception of a final input by the receiving unit and a second timer for measuring the passage of time from the point the plurality of image forming units stop, the calculating unit determining registration correction values for correcting deviance of the images based on an output from the registration pattern detecting unit and requesting an update of the registration correction value based on at least one of 1) the temperature detected by the fixing temperature detecting unit and 2) a value of the first timer and/or the second timer, wherein the calculating unit does not request an update based on the temperature detected by the fixing temperature unit when an update has already been requested the value of the first timer and/or the second timer.

Another aspect of the image forming apparatus of the present invention comprises: a plurality of image forming units for respectively forming images on a recording medium; a remainder detecting unit for detecting an amount of remaining recording media remaining in a recording media accommodating unit; a registration pattern detecting unit for detecting registration patterns formed by the plurality of image forming units; a calculating unit connected with the remainder detecting unit and the registration pattern detecting unit, said calculating unit determining a registration correction values for correcting deviance of the images based on an output from the registration pattern detecting unit and requesting an update of the registration correction value when the amount of remaining recording media detected by the remainder detecting unit is less than a predetermined value.

The present invention provides an image forming apparatus an image forming apparatus capable of reducing the time required for copying in an image forming apparatus which performs a registration correction process.

Another aspect of the present invention is an image forming apparatus comprising: a plurality of image forming units for respectively forming images on a recording medium; a residual toner detecting unit for detecting the amount of remaining toner accommodated in each of the plurality of image forming units; a registration pattern detecting unit for detecting registration patterns formed by the plurality of image forming units; and a calculating unit connected with the residual toner detecting unit and the registration pattern detecting unit, the calculating unit determining a registration correction values for correcting deviance of the images based on output from the registration pattern detecting unit and requesting an update of the registration correction values when the amount of remaining toner of at least one among the plurality of image forming units detected by the residual toner detecting unit is in a depleted state at less than a predetermined value.

In an image forming apparatus that comprises a plurality of image forming units for respectively forming images on a recording medium and a fixing unit for fusing the images formed on the recording medium to the recording medium, another aspect of the present invention is a method of updating registration correction values for correcting deviance of the images comprising the steps of: (1) detecting a temperature of the fixing unit; and (2) executing, in a case where the detected temperature satisfies a predetermined condition, the following steps (2-1) through (2-3): (2-1) forming registration patterns by using the plurality of image forming units; (2-2) detecting the registration patterns; and (2-3) updating the registration correction values based on the detected registration patters.

A yet another aspect of the present invention is a computer-readable medium have stored thereon a plurality of sequences of instructions, said plurality of sequences of instructions including sequences of instructions which, when executed by a processor, cause said processor to perform the steps of: (1) detecting a temperature of the fixing unit in an image forming apparatus having a plurality of image forming units for respectively forming images on a recording medium; and (2) executing, in a case where the detected temperature satisfies a predetermined condition, the following steps (2-1) through (2-3): (2-1) forming registration patterns by using the plurality of image forming units; (2-2) detecting the registration patterns; and (2-3) updating the registration correction values based on the detected registration patters.

The present invention provides an image forming apparatus capable of reliably performing a registration correction process.

BRIEF DESCRIPTION OF THE DRAWINGS

These and other objects, advantages and features of the invention will become apparent from the following description thereof taken in conjunction with the accompanying drawings in which.

DESCRIPTION OF THE PREFERRED EMBODIMENTS

A digital copier of one embodiment of the present invention is described hereinafter with reference to the accompanying drawings. Like parts are designated by like reference numbers throughout the several drawings.

Figure 1:
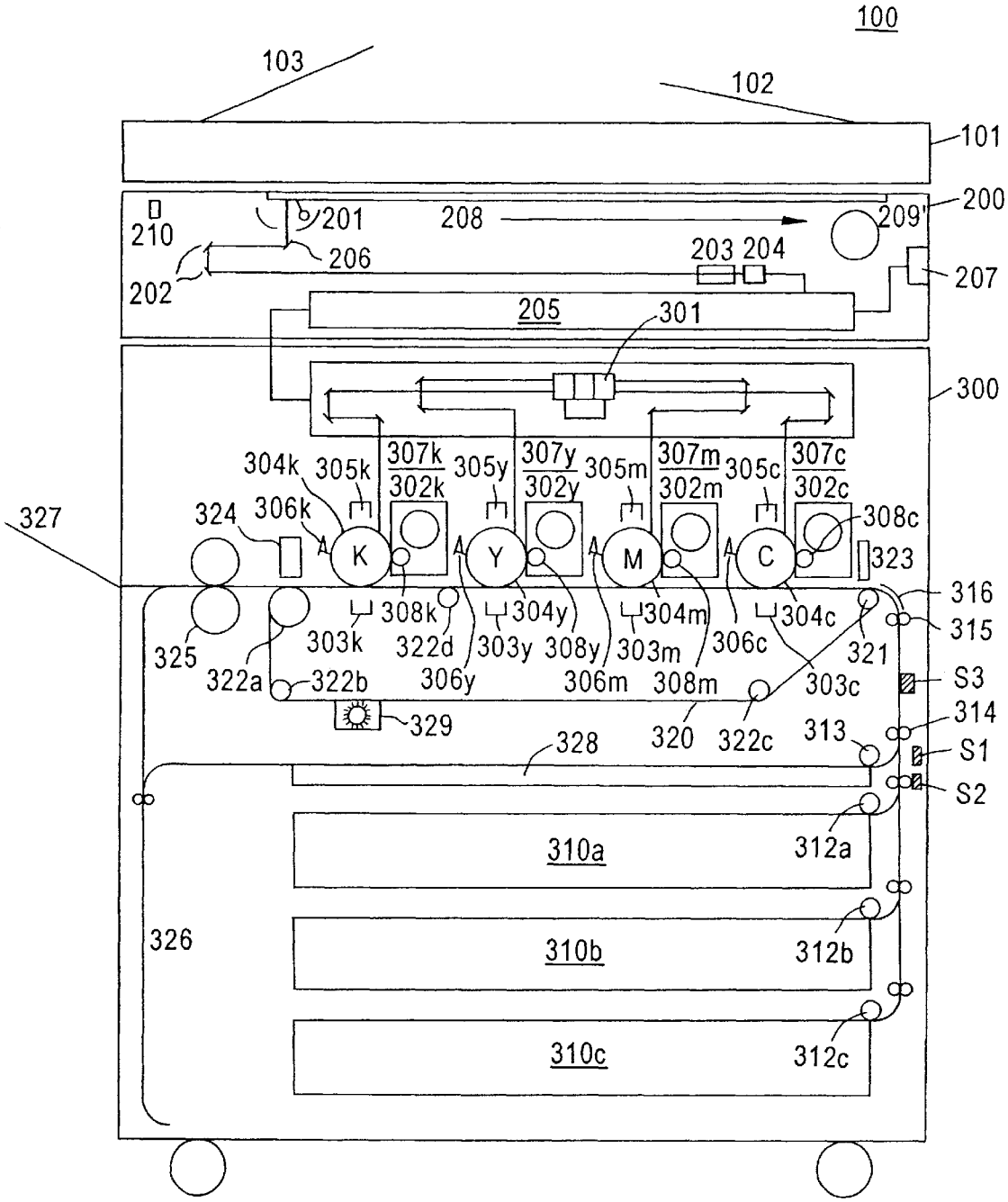
FIG. 1 is a schematic cross section briefly showing the construction of a digital copier of one embodiment of the present invention.

Referring to FIG. 1, a digital copier 100 comprises an automatic document feeder 101 for automatically transporting a document to an image reading position, an image reading unit 200 for reading image data from a document, and an image forming unit 300 for forming the image on a paper sheet.

The automatic document feeder 101 automatically transports a document placed in a document tray 102 to the image reading position of the image reading unit 200 when a print command is specified from a control panel described later. When the document reading ends by the document reading unit 200, the document is ejected from the image reading position to a discharge tray 103. When a plurality of documents are stacked on the document tray 102, the documents are transported sequentially from the lowermost document in the stack, the image is read, and the document ejected in sequential operations of high efficiency.

The image reading unit 200 exposes the image of a document placed on a document glass 208 via an exposure lamp 201 attached to a scanner which moves below the document glass 208. The light reflected from the document is directed to a lens 203 by a first mirror 206 and two reflective mirrors 202 so as to form an image on a CCD sensor 204. The exposure lamp 201 and the first mirror 206 are attached to a scanner, and the scanner moves at a speed V in accordance with the copy magnification in the arrow direction (subscan direction) in the drawing via a scanner motor 209. In this way, the entire surface of a document placed on the document glass 208 can be scanned. The two reflective mirrors 202 move at a speed V/2 in the arrow direction in the drawing in conjunction with the movement of the exposure lamp 201 and the first mirror 206. In this way, the light emitted from the exposure lamp 201 which illuminates the document normally has a fixed optical path length from the reflection from the document to the formation of an image on the CCD sensor 204.

The position of the scanner on which the exposure lamp 201 and the first mirror 206 are mounted is detected at the home position by a home position sensor 210. The amount of scanner movement is detected by the number of steps of the scanner motor 209. In this way the scanner position is detected by detecting the amount of movement of the scanner from the home position.

The reflected light forming an image on the CCD sensor 204 is converted to electrical signals within the CCD sensor 204, and these signals are transmitted to an image processing circuit 205. In the image processing circuit 205, the received electrical signals are subjected to analog processing, A/D conversion processing, and digital image processing, and subsequently are recorded in memory within the image processing circuit 205. Furthermore, data identical to the data stored in memory are output to an interface 207.

The image processing circuit 205 converts either the image data stored in memory or the image data input by the interface 207 to print data of cyan (C), magenta (M), yellow (Y), and black (K), and transmits these data to the image forming unit 300.

In the image forming unit 300, the received print data are sent to the respective cyan, magenta, yellow, black exposure heads. Each exposure head emits a laser beam corresponding to the received print data (electrical signals). The emitted laser beams performs a primary scan via a polygonal mirror 301 so as to expose the photosensitive drums 304*c*, 304*m*, 304*y*, 304*k* within the respective cyan, magenta, yellow, and black image forming units 307*c*, 307*m*, 307*y*, 307*k*. Since the image forming units 307*c*, 307*m*, 307*y*, 307*k* differ only in the color of the toner accommodated therein, the operation of the image forming unit 307*c* for forming a cyan color image is described below.

After the photosensitive drum 304*c* is charged by a charger 305*c*, the surface is irradiated by the laser beam emitted from the cyan exposure head. In this way, an electrostatic latent image is formed on the surface of the photosensitive drum 304*c*. Then, toner is deposited on the electrostatic latent image by a developing device 302*c* to form a toner image. The toner image formed on the photosensitive drum 304*c* is transferred via a transfer charger 303*c* to a recording medium supported on an endless belt 320.

The photosensitive drum 304*c* is normally in contact with a resin blade 306*c* which removes the surplus toner adhered to the photosensitive drum 304*c*.

In this way, continual image forming processes are performed by rotating the photosensitive drum 304*c* in a clockwise direction in the drawing. The image forming units 307*c*, 307*m*, 307*y*, 307*k* are respectively integrated in construction so as to be removably installed in the digital copier 100.

Paper sheets of different sizes are respectively accommodated in cassettes 310*a*, 310*b*, and 310*c*. A sheet of desired size is fed to a transport path by a feed roller 312*a*, 312*b*, 312*c* attached to the cassettes 310*a*, 310*b*, 310*c*. The sheet fed to the transport path is transported to a timing roller 315 by a pair of transport rollers 314.

On the other hand, the endless belt 320 looped without slack around a drive roller 322*a*, stationary rollers 322*b*, 322*c*, 322*d*, and movable roller 321. When the drive roller 322*a* is rotated in a counterclockwise direction in the drawing, the endless belt 320 is rotated at predetermined speed in a counterclockwise direction in the drawing. The rollers 322*b*, 322*c*, 322*d* are rotated counterclockwise in conjunction with the rotation of the endless belt 320.

The endless belt 320 has a seam since it is endless, and this seam is used as a standard mark of the endless belt. A timing sensor 323 is disposed at the position at which the sheet is supplied to the endless belt 320, so as to detect the standard mark of the endless belt 320. The timing roller 315 feeds the paper sheet to the endless belt 320 synchronously with a detection signal output from the timing sensor 323. In this way, the paper sheet is fed to the endless belt 320 so as to not ride on the seam (standard mark) of the endless belt 320. A guide 316 is provided to facilitate the feeding of the sheet from the timing roller 315 to the endless belt 320.

The sheet fed to the endless belt 320 is supported on the endless belt 320 and transported to the left in the drawing. In this way, the sheet sequentially comes into contact with the photosensitive drums 304*c*, 304*m*, 304*y*, 304*k* of the cyan, magenta, yellow, and black image forming units. When the recording medium comes into contact with the photosensitive drums 304*c*, 304*m*, 304*y*, 304*k*, the toner image is transferred onto the sheet via transfer chargers 303*c*, 303*m*, 303*y*, 303*k* disposed opposite the respective photosensitive drums.

The registration correction sensors 308*c*, 308*m*, 308*y*, 308*k* installed within each image forming unit 307*c*, 307*m*, 307*y*, 307*k* detect the standard mark of the endless belt 320. The timing detected by the registration correction sensors 308*c*, 308*m*, 308*y*, 308*k* is transmitted to the image processing circuit 205 to micro-adjust the timing of the image formation by the image forming units 307*c*, 307*m*, 307*y*, 307*k*. In this way, color shift due to registration dislocation is prevented.

The sheet bearing the transferred toner is transported to a pair of fixing rollers 325, and heated by the pair of fixing rollers 325. In this way, the toner is melted and fused to the sheet. Thereafter, the sheet is ejected to the discharge tray 327.

When making a duplex copy, the sheet bearing the toner image fixed by the pair of fixing rollers 325 is inverted by a sheet inverting unit 326, and transported to a duplex unit 328. The sheet inverted by the duplex unit 328 is again transported to the transport path by the feed roller 313. Then, an image is formed on the back side of the sheet by transporting the sheet through the path previously described.

A moisture sensor S1 is a sensor for detecting the moisture within the digital copier 100, and a temperature sensor S2 is a sensor for detecting the temperature within the digital copier 100. A sheet moisture content sensor S3 is a sensor for detecting the water content of the sheet, and normally measures the absorbed moisture in the sheet by detecting the current value flowing through the sheet when in contact with the sheet. The sheet moisture content sensor S3 is provided directly in front of the timing roller 315.

A registration pattern detecting sensor 324 is mounted farthest downstream path of the endless belt 320 transporting the sheet. The registration pattern detecting sensor 324 reads registration patterns formed on the endless belt 320 by the image forming units 307*c,* 307*m,* 307*y,* 307*k.* The read data is transmitted to the image processing circuit 205. The registration pattern detecting sensor has a photo-emitter and a photoreceptor, and the endless belt 320 is illuminated by the light emitter from the photo-emitter, and the light reflected from the endless belt 320 is received by the photoreceptor. The level of the light received by the photoreceptor indicates the position of the registration pattern by the presence/absence of registration pattern on the endless belt 320, and indicates which color of toner forms the registration pattern is present. Furthermore, the position of the registration pattern formed on the endless belt 320 is detected from the timing of the signal output from the registration pattern detecting sensor 324. This is described more fully later.

A toner collector 329 collects the registration patterns formed on the endless belt 320. The toner collector 329 has an internal brush which sweeps the endless belt 320 so as to remove the registration patterns formed by toner on the endless belt 320. The removed toner is stored in a toner receptacle 328.

Figure 2:
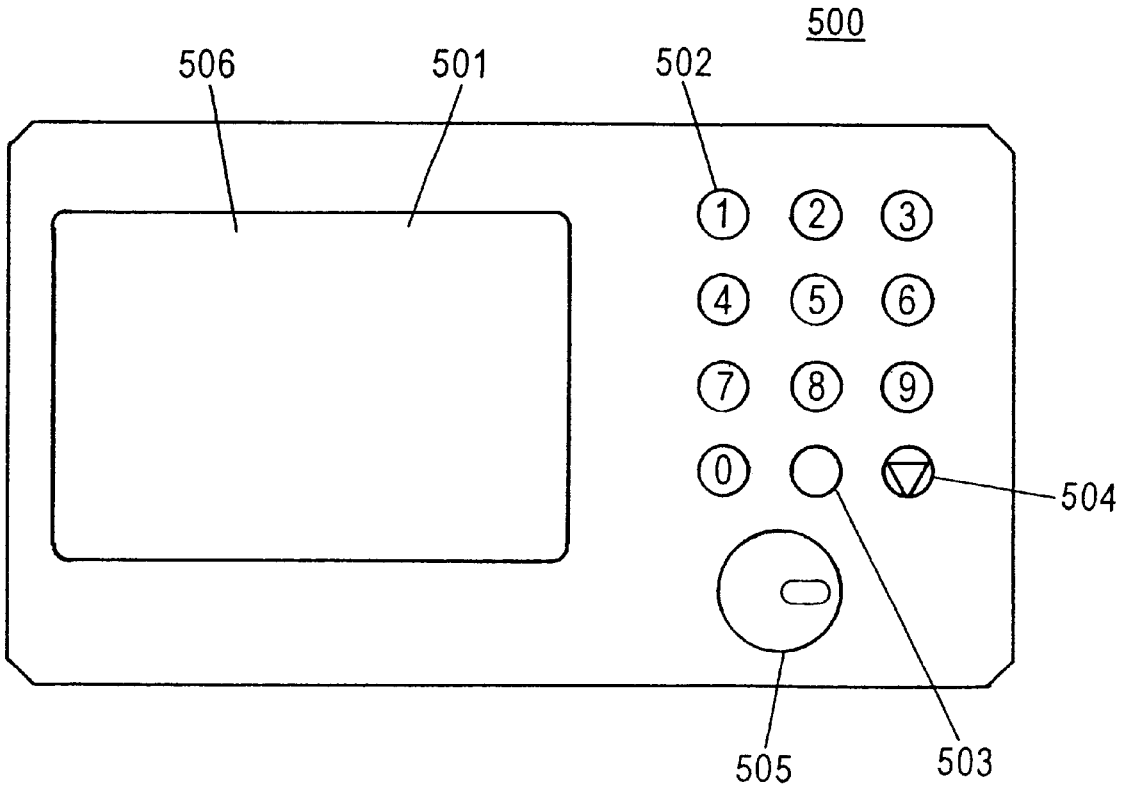
FIG. 2 is a plan view of the operation panel 500 provided on the top surface of the digital copier 100.

FIG. 2 is a plan view of the operation panel provided on the top surface of the digital copier 100. Referring to FIG. 2, the operation panel 500 includes a liquid crystal display device 501, and a touch panel 506 formed of transparent material provided over the liquid crystal display. The liquid crystal display device 501 displays the print operation mode and internal conditions of the digital copier 100. The touch panel 506 is a switch allowing a user to input predetermined operations such as the print mode settings and the like when used in combination with the liquid crystal display 501. The operation panel 500 also includes a ten-key pad 502 for entering numeric values for the number of sheets to be printed, print magnification and the like, a start key 505 for specifying the start of a print operation, a clear key 503 for clearing the print operation mode set via user input, and a stop key 504 for stopping a print operation of the digital copier 100.

Figure 3:
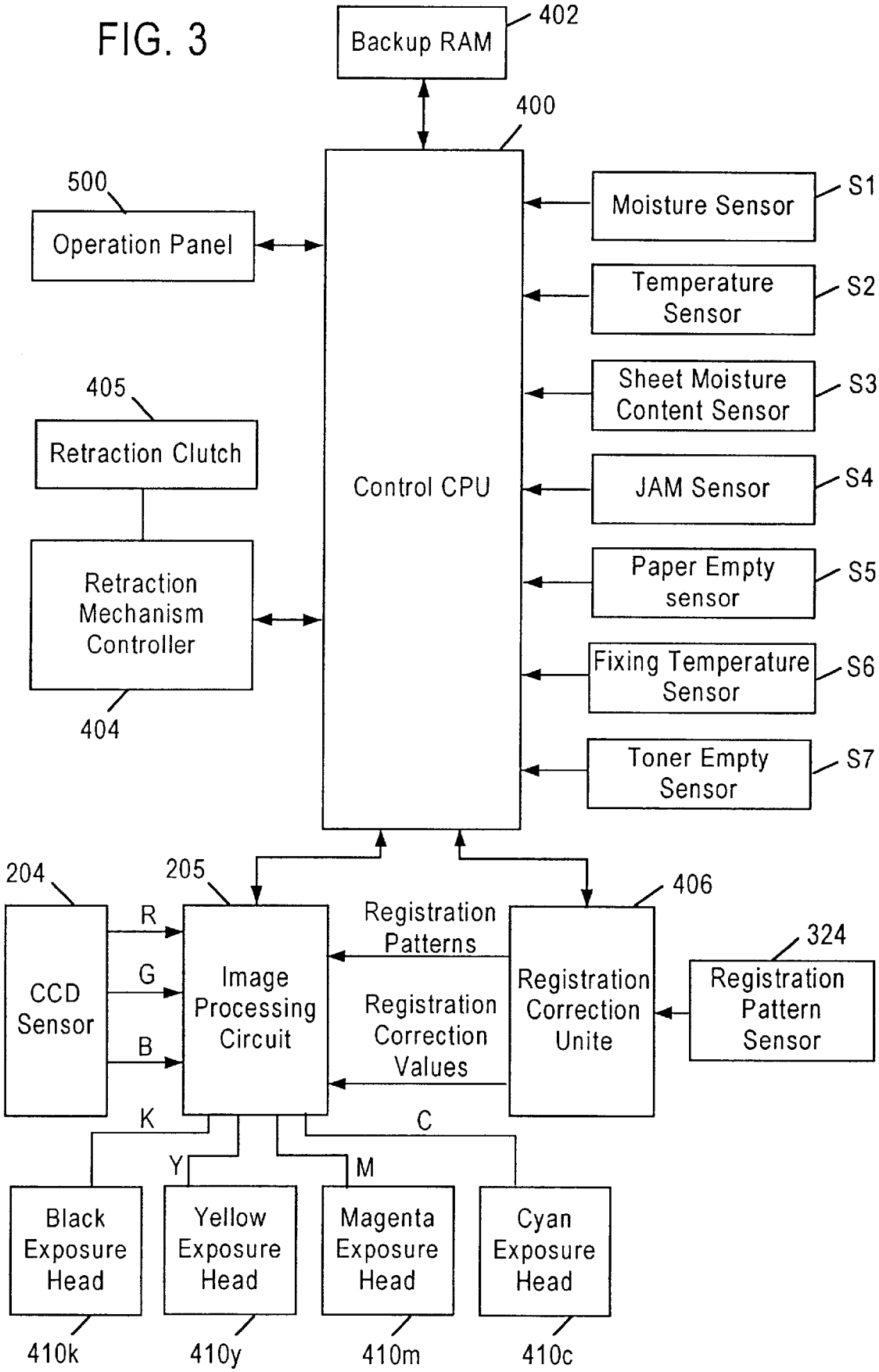
FIG. 3 is a block diagram showing the construction of the controller of the digital copier 100.

The digital copier 100 is controlled by a controller shown in FIG. 3. Referring to FIG. 3, the controller includes a control CPU 400 for overall control of the digital copier 100, a retracting mechanism controller 404 for controlling the retracting mechanism for advancing and retracting the endless belt 320 depending on whether the copier is in a color mode or a black-and-white mode, the previously mentioned image processing circuit 205, and a registration correction unit 406 for calculating the amount of registration correction based on the data output from the registration pattern detecting sensor 324.

The control CPU 400 is connected to the operation panel 500, moisture sensor S1, temperature sensor S2, sheet moisture content sensor S3, JAM sensor S4, paper empty sensor S5, fixing temperature sensor S6, and toner empty sensor S7.

The print mode input by a user via the operation panel 500 is transmitted from the operation panel 500, and data for displaying on the liquid crystal display device 501 is transmitted from the control CPU 400.

The JAM sensor S4 is provided at a plurality of locations in the transport path to detect any paper jams within the sheet transport path. The paper empty sensor S5 is provided in each respective cassette 310*a,* 310*b,* 310*c* to detect the presence/absence of paper within the cassettes 310*a,* 310*b,* 310*c*. The fixing temperature sensor S6 measures the temperature of the pair of fixing rollers 325. The toner empty sensor S7 detects the presence/absence of toner within each respective developing device 302*c,* 302*m,* 302*y,* 302*k* of the image forming units.

The output of the respective sensors S1~S7 are transmitted to the control CPU 400. The control CPU 404 controls the retracting mechanism controller 404 based on the output from the sensors S1~S7. This control is described in detail later.

The control CPU 400 is connected to a backup RAM 402. The backup RAM 402 stores data such that the number of print sheets, and number of operations of elements such as the image forming units within the digital copier 100. The backup RAM 402 is backed up by a battery, so as to maintain the data stored in the backup RAM 402 even when the main power source of the digital copier 100 is turned OFF.

The image processing circuit 205 is connected to the CCD sensor 204, cyan exposure head 410*c,* magenta exposure head 410*m,* yellow exposure head 410*y,* and black exposure head 410*k.* The R, G, B image data photoelectrically converted by the CCD sensor 204 are converted to C, M, Y, K print data by the image processing circuit 205. The converted C, M, Y, K print data are subjected to a registration correction process based on the registration correction value received from the registration correction unit 406, and thereafter are output to the corresponding exposure heads 410*c,* 410*m,* 410*y,* 410*k.*

When the respective exposure heads 410*c,* 410*m,* 410*y,* 410*k* receive the registration-corrected data, a laser beam irradiates the corresponding photosensitive drum based on the received data. In this way, an electrostatic latent image is formed on the photosensitive drum.

The registration correction unit 406 calculates a registration correction value to be used in preventing color shift due to registration dislocation when images are overlaid on the sheet via the image forming units 307*c,* 307*m,* 307*y,* 307*k.*

The registration correction process comprises a step of forming predetermined registration patterns on the endless belt 320 by the image forming units 307*c,* 307*m,* 307*y,* 307*k,* a step of reading the registration patterns formed on the endless belt 320 by the registration pattern detecting sensor 324, a step of calculating registration correction values for deviance correction, e.g., print position correction, magnification correction, and correcting spatial distortion based on the data read by the registration pattern sensor 324, and a step of subjecting the C, M, Y, K print data to registration correction based on the calculated registration correction values.

The registration correction unit 406 stores registration patterns beforehand, and transmits the registration patterns to the image processing circuit 205 to form the registration patterns on the endless belt 320 by the respective image forming units 307*c,* 307*m,* 307*y,* 307*k.*

Figure 4:
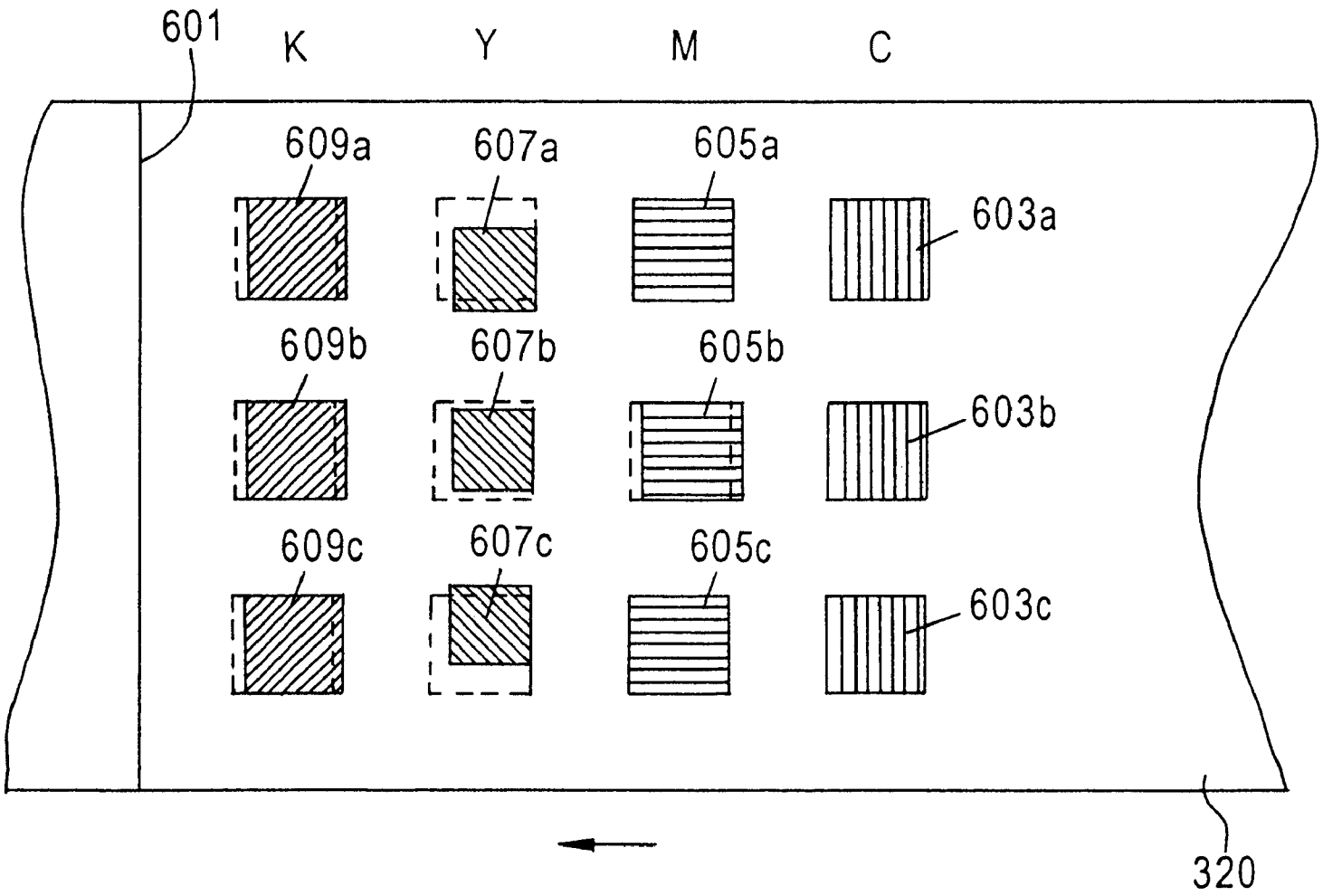
FIG. 4 illustrates a registration pattern.

FIG. 4 shows an example of registration patterns. Referring to the drawing, the registration patterns are formed at a predetermined position on the endless belt 320 referenced to the seam 601 of the endless belt 320 by the respective image forming units. Each set of the registration patterns is a pattern of three squares arranged at equal spacing in a direction perpendicular to the direction of travel of the endless belt 320 (arrow direction in the drawing). Although the registration patterns in the example uses squares, other shapes may be used, e.g., text shapes such as +, or Z.

Each of the registration patterns formed by the image forming units is to be formed in an intended shape at an intended position from the standard mark 601. However, the intended shape and/or the intended position are/is not maintained when registration dislocation occurs. The registration correction values are determined from the amount of dislocation of the actually formed registration patterns.

In this example, the registration patterns 603*a,* 603*b,* 603*c* formed by the image forming unit 307*c* are formed at predetermined positions set from the standard mark 601.

The registration patterns 605*a* and 605*c* from among the registration patterns 605*a,* 605*b,* 605*c* formed by the image forming unit 307*m* are formed at the set positions, but the registration pattern 605*b* is shifted from the set position in the opposite direction to the direction of travel of the endless belt 320 (arrow direction in the drawing). In the drawing, the intended position at which the registration pattern should be formed is indicated by the dashed line. When the three registration patterns are relatively dislocated in this way, the spatial distortion is detected from the amount of relative dislocation, and a registration correction value is determined to correct the spatial distortion.

The registration patterns 607*a,* 607*b,* 607*c* formed by the image forming unit 307*y* are formed smaller than the standard size of the registration pattern. The registration patterns 607*a* and 607*c* also are formed shifted to the registration pattern 607*b* side from the standard positions. The registration correction value for magnification correction is determined from the amount of dislocation in position and size.

The registration patterns 609*a,* 609*b,* 609*c* formed by the image forming unit 307*k* are shifted in equal amounts in the opposite direction of the direction of travel of the endless belt 320 (arrow direction in the drawing). The registration correction value for print position correction is determined from the amount of dislocation from this position.

In this way, in the registration correction process, predetermined registration patterns are formed on the endless belt 320 by each image forming unit 307*c,* 307*m,* 307*y,* 307*k* by transmitting the registration patterns from the registration correction unit 406 to the image processing circuit 205. The registration correction values to be used for print position correction, magnification correction, and spatial distortion correction are determined by reading the registration patterns via the registration pattern detecting sensor 324 to detect the dislocation of the read registration pattern from the standard position. The registration correction values determined by the registration correction unit 406 are stored in a register within the image processing circuit 205 and the backup RAM 402.

Figure 5:
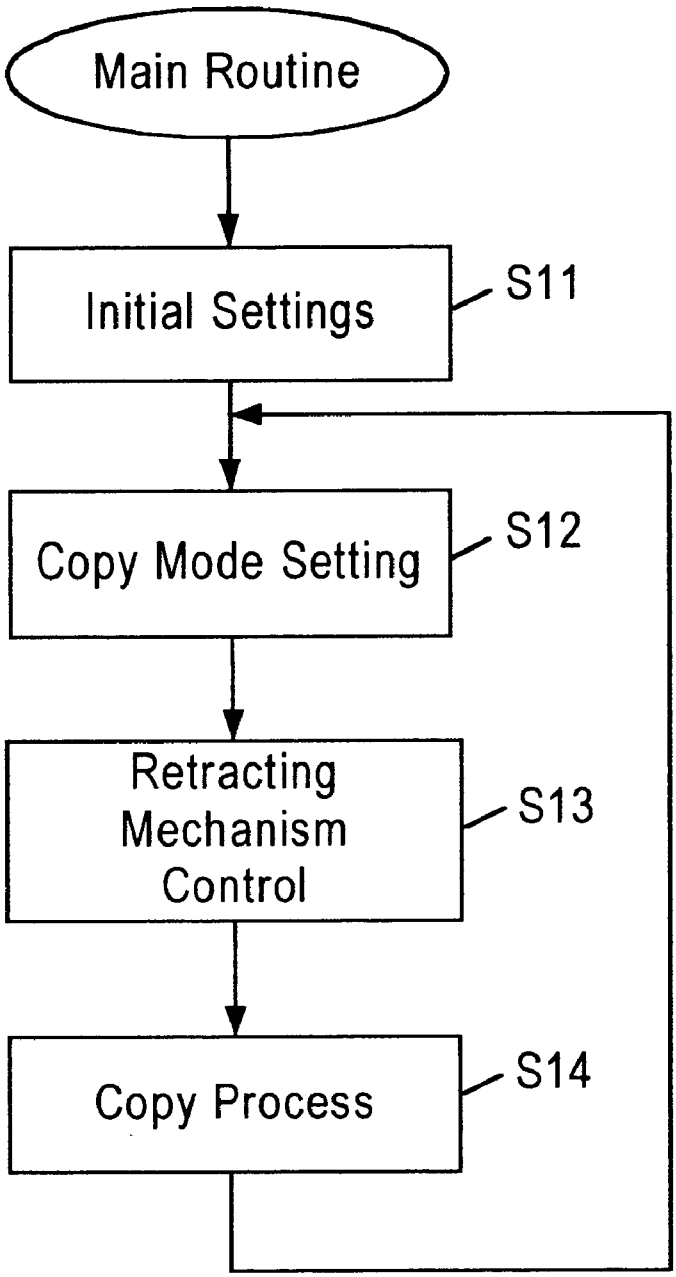
FIG. 5 is a flow chart showing the flow of the processes executed by the controller of the digital copier 100.

The flow of the processing executed by the controller of the digital copier 100 is described below. FIG. 5 is a flow chart showing the flow of the processes executed by the controller of the digital copier 100. Referring to the drawing, the processes executed by the controller include a step of initializing settings of the digital copier 100 (#11), a step of setting the copy mode of the digital copier 100 (#12), a step of controlling the retracting mechanism (#13), and a step of executing the copy process (#14).

In initializing the settings in step #11, when the main power source of the digital copier 100 is turned ON, processes are executed, e.g., a process of raising the temperature of the pair of fixing rollers 325. Initialization is a preliminary operation necessary for performing the copy process by the digital copier 100.

In step #12, the copy mode is set. Setting the copy mode is accomplished by a user from the operation panel 500 by input from the touch panel 506 or the ten-key pad 502 in accordance with the menu displayed on the liquid crystal display device 501. In the copy mode, various settings are performed including, for example, setting the number of copies, copy magnification, or image forming mode. Setting the image forming mode involves selecting either a black-and-white image forming mode and a color image forming mode. The black-and-white image forming mode is a mode in which the copy process is executed using only the black image forming unit 307*k*. The color image forming mode is a mode in which the copy process is performed using all image forming units 307*c,* 307*m,* 307*y,* 307*k*. For example, when the black-and-white image forming mode is selected, the copy process is executed using only the black image forming unit 307*k* even if the document is a color document.

In step #14, the copy process is performed. An image is formed based on the copy mode set in step #12.

Figure 6:
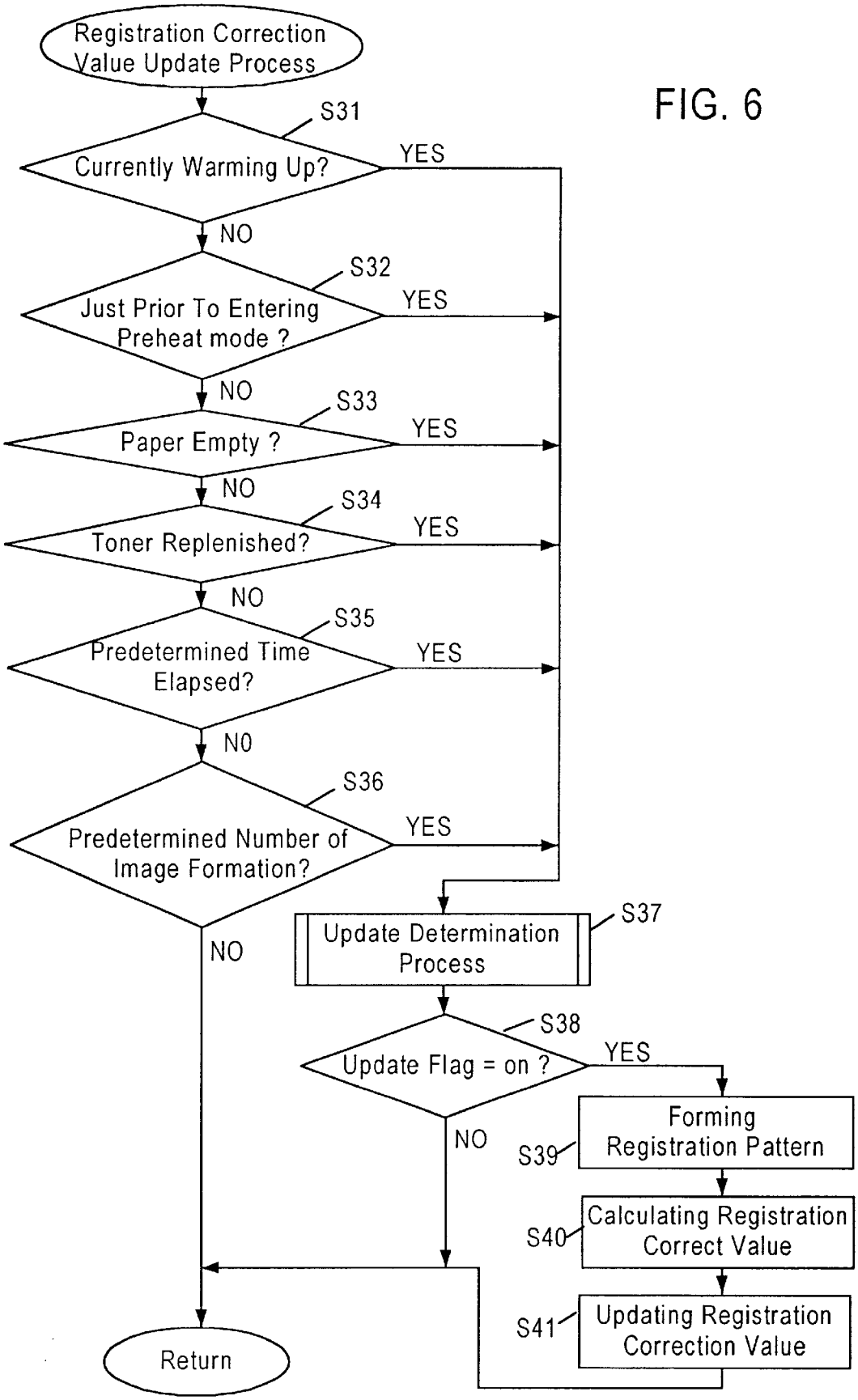
FIG. 6 is a flow chart showing the flow of the registration correction value update process executed by the controller in the digital copier 100.

The registration correction value update process is described below. The registration correction value update process is a process executed independently from the main routine, and is performed at predetermined time intervals, e.g., every 10 minutes. FIG. 6 is a flow chart showing the flow of the registration correction value update process. Referring to the drawing, the registration correction value update process includes a step of determining whether or not the digital copier 100 is currently warming up (#31), a step of determining whether or not the digital copier 100 is just prior to entering the preheat mode (#32), a step of determining whether or not the cassettes 310*a,* 310*b,* 310*c* are empty based on the output of the paper empty sensors S5 of the digital copier 100 (#33), a step of determining whether or not toner has been replenished after a toner empty condition is reported by the toner empty sensor S7 (#34), a step of determining whether or not a predetermined time has elapsed since the previous registration correction value update was performed (#35), a step of determining whether or not a predetermined number of image formations has been performed in the color image forming mode (#36), a step of executing an update determination process to determine whether or not a registration correction value update is required (#37), a step of determining whether or not a registration correction value update is required (#38), a step of executing a process to form the registration pattern (#39), a step of calculating a registration correction value (#40), and a step of updating and rewriting the calculated registration correction value (#41).

In step #31, a determination is made as to whether or not the digital copier 100 is currently warming up. Warm up is a process of heating the pair of fixing roller 325 of the digital copier 100 to a predetermined temperature. The temperature of the pair of fixing rollers 325 is measured by the fixing temperature sensor S6. Accordingly, warm up is the time and period during which the temperature detected by the fixing temperature sensor S6 is increasing. Since the pair of fixing rollers 325 have thickness, time is required to attain the predetermined temperature. However, the time until the fixing rollers attain the predetermined temperature can be shortened when the fixing rollers 325 near a temperature sufficient to fix the toner to the sheet.

Accordingly, if the registration correction value update process can be executed during the time until the pair of fixing rollers 325 attain the predetermined temperature, a user can reduce the frequency of starting the registration correction value update process while using the digital copier 100. As a result, the total standby time is reduced when using the digital copier 100, and copy production is improved. Since the toner image (regist pattern) is formed on the endless belt 320 in the registration correction value update process, the pair of fixing rollers 325 need not be used since the toner need not be fixed to the sheet.

The process of determining whether or not warm up is on-going executed in step #31 is described in detail later.

When it is determined in step #31 that warm-up is currently on-going, the routine advances to step #37, whereas otherwise the routine advances to step #32.

In step #32, a determination is made as to whether or not the digital copier 100 is just prior to entering the preheat mode. The preheat mode is a mode which reduces power consumption of the digital copier 100 by stopping the display on the liquid crystal display device 501 of the operation panel 500, and turning OFF the power of the heating source to maintain the predetermined temperature of the pair of fixing rollers 325 when a user has not entered initial operation instructions to the digital copier 100, or when the image forming units 307*c,* 307*m,* 307*y,* 307*k* have not operated for a predetermined period. Accordingly, a timer is provided to count the time passing from the final input from the operation panel 500, and a timer is provided to count the time passing from when the image forming units 307*c,* 307*m,* 307*y,* 307*k* stopped operation, and just prior to the preheat mode is when both these timers register a value greater than a predetermined value. Furthermore, just prior to the preheat mode may be when either of these timers register a value greater than a predetermined value.

Consider that the possibility of a user using the digital copier 100 is low when a user has not specified a predetermined operation of the digital copier 100, and when a predetermined time has elapsed since the image forming unit operation has stopped. By executing the registration correction value update process when the digital copier 100 is in such states, a user can reduce the frequency of starting the registration correction value update process while using the digital copier 100. As a result, the total standby time is reduced, and copy production is improved.

When it is determined that the digital copier 100 is just prior to entering the preheat mode, the routine advances to step #37, whereas otherwise the routine advances to step #33.

In step #33, a determination is made as to whether or not the cassettes 310*a,* 310*b,* 310*c* are empty based on the output of the paper empty sensors S6. When the cassettes 310*a,* 310*b,* 310*c* become depleted of paper while the digital copier 100 is performing a copy operation, the image forming process of the digital copier 100 is interrupted. A user replenished paper in the cassettes 310*a,* 310*b,* 310*c* in accordance with a message (i.e., a message specifying paper re-supply) displayed on the liquid crystal display 501 of the operation panel 500. The digital copier 100 maintains the state of interrupted image forming process while the user replenishes the paper in the cassette. The paper empty condition has no connection with the registration correction value update process since the toner image is formed on the endless belt 320 in the registration correction value update process. Accordingly, the registration correction value update process can be performed while the paper is being replenished in the cassettes 310*a,* 310*b,* 310*c*. In this way, the frequency of starting the registration correction value update process while using the digital copier 100 can be reduced. As a result, the total standby time is reduced, and copy production is improved.

When a paper empty condition is determined, the routine advances to step #37, whereas otherwise the routine advances to step #34.

In step #34 a determination is made as to whether or not toner has been replenished. The amount of toner in the image forming apparatus is determined by the toner empty sensors S7. The registration correction process is not performed when it is determined that the toner detected by the toner empty sensor S7 is less than the amount required for image formation. If the registration pattern is formed when the amount of toner is insufficient, a reliable registration pattern cannot be formed, and an accurate registration correction value cannot be calculated. Accordingly, performing the registration correction process is prohibited when there is insufficient toner. In this way, the reliability of the registration correction value is ensured. On the other hand, when considering that the registration correction value will change based on the number of copies made and the passage of time, the reliability of the registration correction number is gradually reduced as the number of copies made increases and as more time passes. For this reason, the registration correction process is performed directly after toner is newly replenished to ensure the reliability of the registration correction value.

When the toner empty sensor S7 detects a change from a state of toner sufficiency to a state of toner insufficiency, the routine advances to step #37, whereas otherwise the routine advances to step #35.

In step #35, a determination is made as to whether or not a predetermined time has elapsed since the previous registration correction value update process. The time of the previous registration correction value update process is stored in the backup RAM 402, and the elapsed time since the previous registration correction value update process can be determined by comparing the current time with the time of the previous registration correction value update process stored in the backup RAM 402. The elapsed time is compared with a predetermined time. When the elapsed time is greater than the predetermined time, the routine advances to step #37, whereas otherwise the routine advances to step #36.

In setup #36, a determination is made as to whether or not the number of image formations in the color image forming mode exceeds a predetermined number. The number of image formations performed in the color image forming mode is stored in the backup RAM 402. When the number of image formations stored in the backup RAM 402 is greater than a predetermined number, the routine advances to step #37, whereas otherwise the routine ends. In step #37, an update determination process is executed to determine whether or not it is necessary to perform the registration correction value update process. This process is described in detail later.

In step #38, when it is determined that a registration correction value update is required based on the result of the update determination process of step #37 (correction data update request flag=ON), the routine advances to step #39, whereas otherwise the routine ends.

In step #39, the registration pattern is formed by the image forming units 307*c,* 307*m,* 307*y,* 307*k* to measure the registration correction value. In step #40, the registration correction value is calculated by the registration correction unit 406. In step #41, the registration correction value stored in the internal register in the image processing circuit 205 is rewritten with the registration correction value calculated in step #40. In this way, the registration correction value is updated with a new value.

Figure 7:
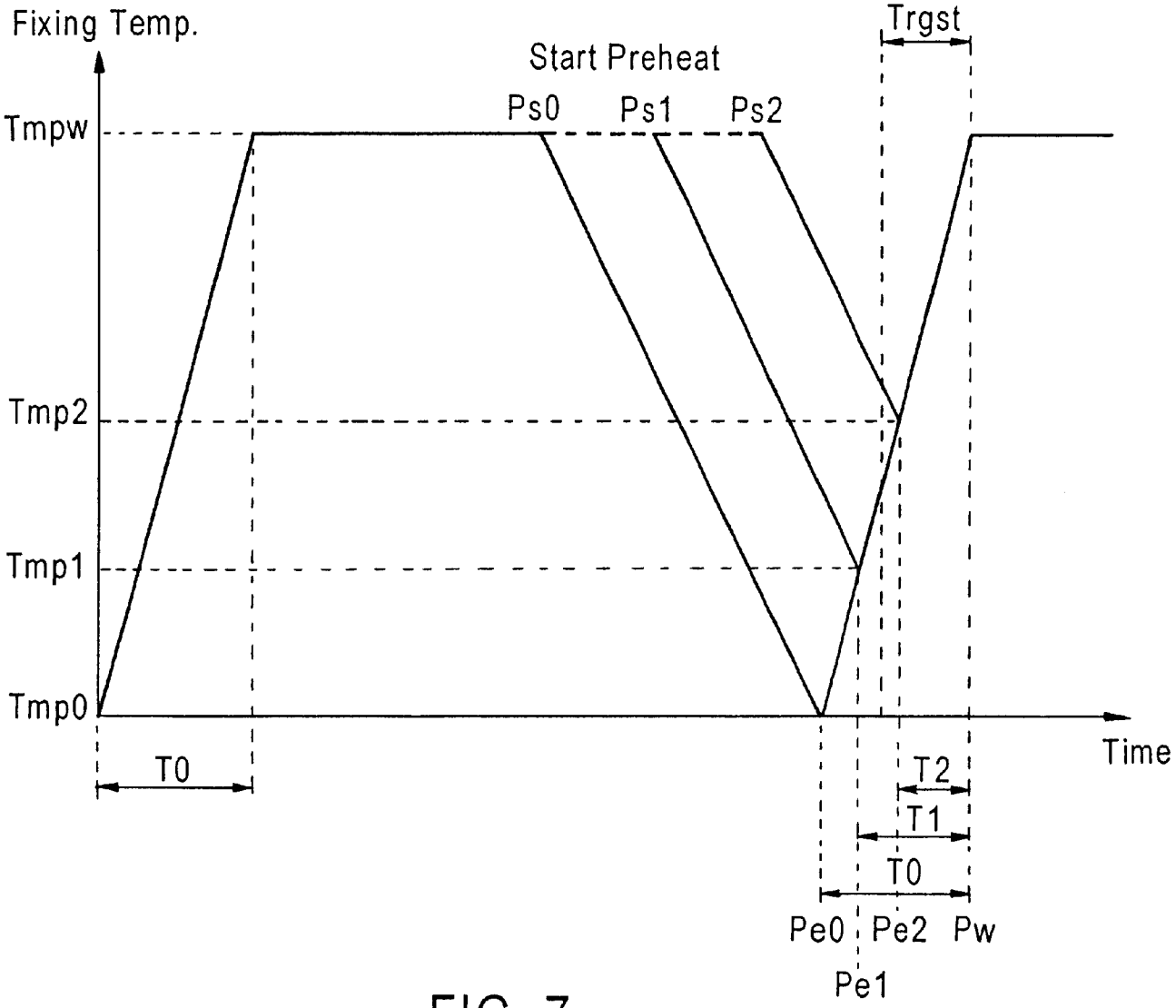
FIG. 7 shows the relationship between the time transition of temperature of the pair of fixing rollers 325 (fixing temperature) and the time of the registration correction value update process.

The warm-up determination process for determining whether or not warm up is currently on-going executed in step #31 of FIG. 6 is described below. FIG. 7 shows the relationship between the time transition of temperature of the pair of fixing rollers 325 (fixing temperature) and the time of the registration correction value update process. Referring to the drawing, the temperature at which toner can be fixed to the sheet by the pair of fixing rollers 325 is designated Tmpw, and the temperature (normally room temperature) when temperature of the pair of fixing rollers 325 is not performed is designated Tmp0. When the main power source of the digital copier 100 is turned ON, the pair of fixing rollers 325 are heated to increase the temperature from temperature Tmp0 to temperature Tmpw. Period T0 is the time required for warm-up when the main power source is turned ON. In this instance, T0 is set at 8 minutes.

When the digital copier 100 has not operated for a predetermined time, or when the image forming units have not operated for a predetermined time, the preheat mode is entered. Times Ps0, Ps1, and Ps2 represent the three times at which the preheat mode starts. Time Pe0 corresponding to time Ps0 represents the time at which warm-up starts following recovery from the preheat mode. Times Pe1 and Pe2 represent the times at which warm-up starts following recovery from the preheat modes corresponding to times Ps1 and Ps2 for starting the preheat mode.

Accordingly, the time from time Ps0 to time Pe0 is the time of controlled reduced power consumption by the digital copier 100 via the preheat mode. This time is set at 16 minutes. Similarly, the time of controlled reduced power consumption from time Ps1 to time Pe1 is set at 12 minutes, and the time of controlled reduced power consumption from time Ps2 to time Pe2 is set at 8 minutes.

The fixing temperature decreases from Tmpw to Tmp1 during the time of controlled power consumption from time Ps1 to time Pe1. The temperature Tmp1 at this time is set at 60° C. The fixing temperature decreases to Tmp2 during the time of controlled power consumption from time Ps2 to time Pe2. The temperature Tmp2 at this time is set at 110° C.

In this way, the fixing temperature decreases as the duration of the preheat mode increases, such that the fixing temperature decreases proportionally to the duration of the preheat mode.

When the preheat mode changes to the warm-up mode and the fixing temperature is Tmp0, the time T0 elapses from time Pe0 to time Pw. When the fixing temperature is Tmp1, the time T1 elapses from time Pe1 to time Pw. Similarly, when the fixing temperature is Tmp2, the time T2 elapses from time Pe2 to time Pw. In this case, the time T1 is set at, for example, 6 minutes, and time T2 is set at 4 minutes. In this way, the time required for warm-up after recovery from the preheat mode is proportional to the fixing temperature. This proportionality is not a linear relationship and represents a nonlinear relationship.

Accordingly, the time necessary for warm-up after recovery from the preheat mode can be estimated from the fixing temperature. If the time required for the registration correction value update process is less than the time required for the estimated warm-up, there is no time loss if the registration correction value update process is performed.

In the drawing, the time required for the registration correction value update process is represented by Trgst. If the registration correction value update process can only be performed at time T0 and T1 which are longer than time Trgst required for the registration correction value update process among the estimated times T0, T1, T2, there is no time loss incurred by performing the registration correction value update process.

Figure 8:
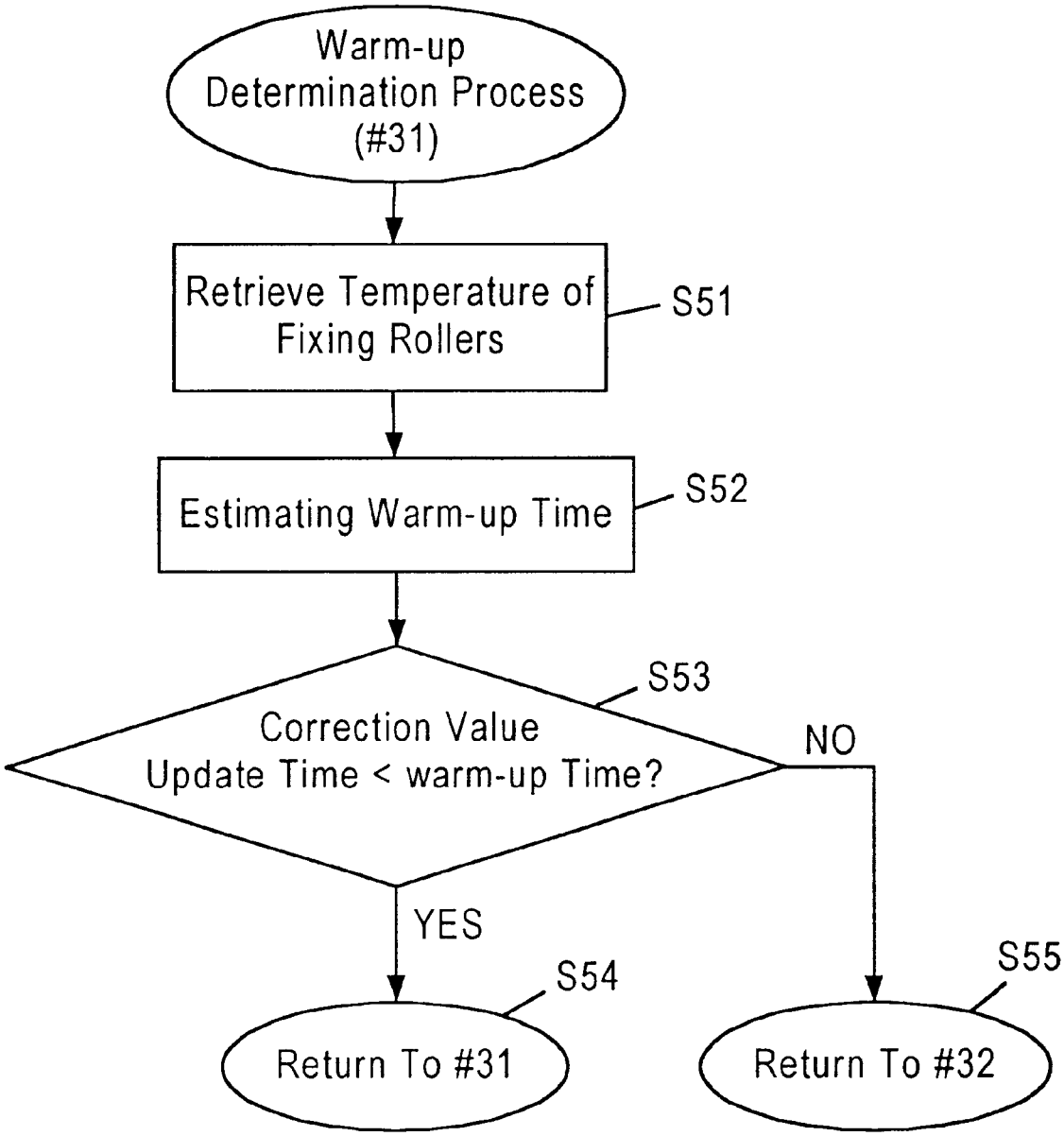
FIG. 8 is a flow chart showing the flow of the warm-up determination process executed in step #37 of FIG. 6.

FIG. 8 is a flow chart showing the flow of the warm-up determination process for determining whether or not warm-up is currently on-going in step #31 of FIG. 6. Referring to the drawing, first, the temperature of the pair of fixing rollers 325 is read by the fixing temperature sensor S6 (#51). Then, the time required for warm-up (warm-up time) is estimated from the read temperature of the fixing rollers 325 (#52). Next, a determination is made as to whether or not the time required to update the registration correction value (correction value update time) is less than the time required for warm-up estimated in step #52 (#53). When the correction value update time is less than the warm-up time (#53: YES), the routine is returned by YES (#54). When the correction value update time is not less than the warm-up time (#53: NO), the routine is returned by NO (#55).

In this way, the time required from the temperature of the fixing rollers 325 to warm-up is estimated, and when the time required for the registration correction value update process is shorter than the estimated time required for warm-up, the registration correction value update process is started.

Figure 9:
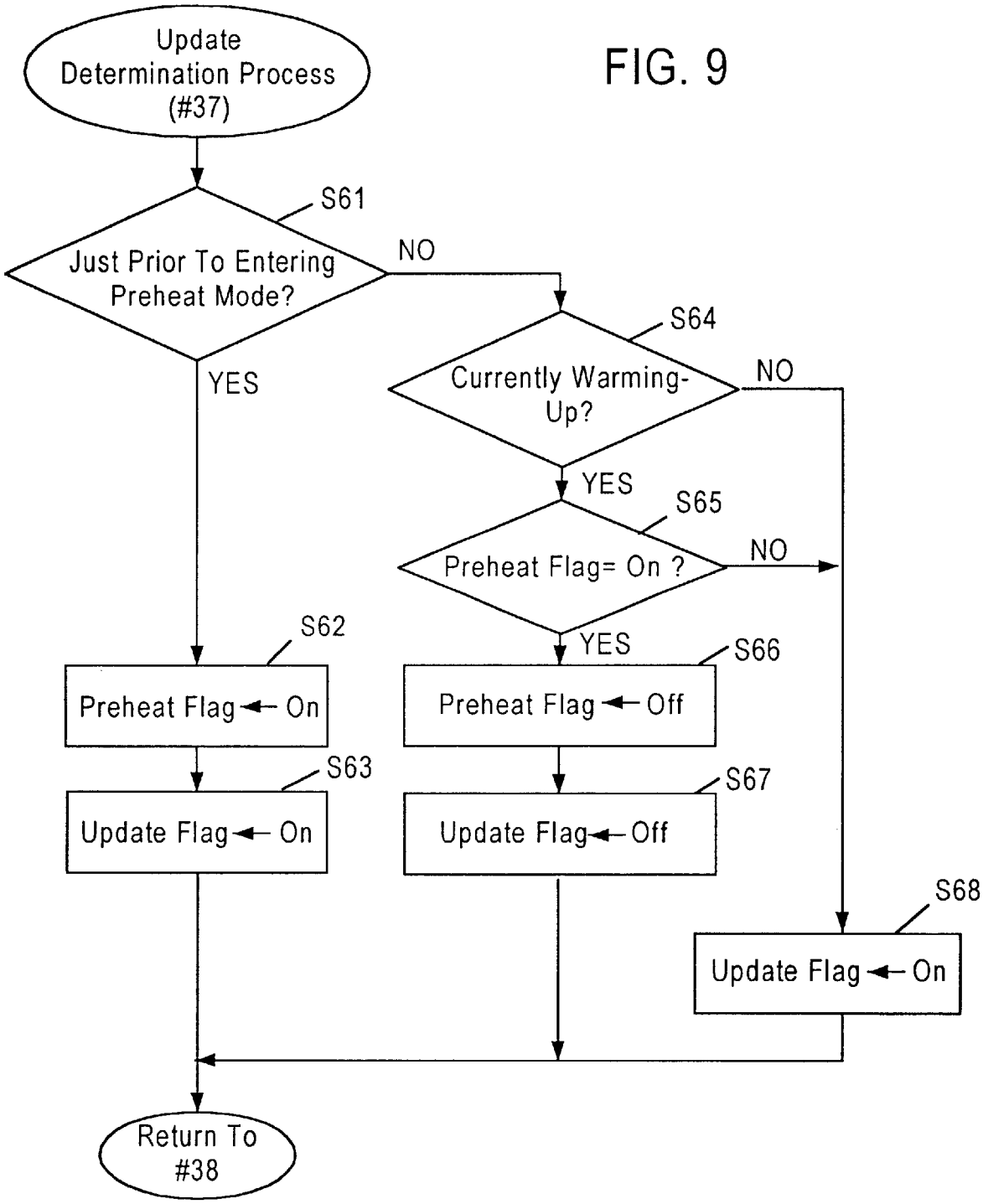
FIG. 9 is a flow chart showing the flow of the update determining process executed in step #37 of FIG. 6.

The update determination process executed in step #37 of FIG. 6 is described below. FIG. 9 is a flow chart showing the flow of the update determination process executed in step #37 of FIG. 6. Referring to the drawing, first, a determination is made as to whether or not the digital copier 100 is just prior to entering the preheat mode (#61). When it is determined that the digital copier 100 is just prior to entering the preheat mode, the preheat flag is set to [ON] (#62), and the update flag is set to [ON] (#63). The preheat flag is a flag representing the preheat mode state; and the digital copier 100 sets the flag at [ON] in the preheat mode state, and the flag is set at [OFF] when the preheat mode is not set.

The update flag is a flag indicating that the start of the registration correction value update process is specified; this flag is set at [ON] when the registration correction value update process is required, and is set at [OFF] when the registration correction value update process is unnecessary. In step #38 of FIG. 6, the state of the update flag is determined, and when the update flag is set at [ON], the registration correction value update process is executed by performing the processes of steps #39~#41.

When it is determined in step #61 that the digital copier 100 is not just prior to entering the preheat mode (#61: NO), a determination is made to determine whether or not the digital copier 100 is currently warming up (#64). When it is determined that warm-up is currently on-going (#64: YES), a determination is made as to whether or not the preheat flag is set at [ON] (#65). When the preheat flag is set at [ON], the preheat flag is set to [OFF] (#66), and the update flag is set to [OFF] (#67). In this way, after the registration correction value update process has once been executed just prior to entering the preheat mode, the registration correction value update process is not executed during warm-up after recovery from the preheat mode. Since the digital copier 100 cannot perform an image forming process during the preheat mode, it is unnecessary to execute the registration correction value update process during warm-up following recovery from the preheat mode when the registration correction value update process has already been executed just prior to entering the preheat mode.

When it is determined that warm-up is not currently on-going in step #64, the routine advances to step #68. Even if it is determined that warm-up is currently on-going in step #64, when the preheat flag is set at [ON], the routine advances to step #68. In step #68 the paper empty flag is set at [ON]. In this way, the update flag is set at [ON] when a paper empty condition is determined in step #33 of FIG.6, when toner has been re-supplied to an image forming device with depleted toner in step #34, when a predetermined time has elapsed from the previous registration correction value update process in step #35, when a predetermined number of image formations has been performed in the color image forming mode in step #36, and when the registration correction value update process has not been executed just prior to entering the preheat mode and warm-up is currently on-going.

As described above, in the digital copier 100 of the present embodiment, the registration correction value update process is performed when warm-up is currently on-going, just prior to entering the preheat mode, or when a cassette is empty. In this way, a user can reduce the frequency of starting the registration correction value update process while using the digital copier 100. As a result, the standby time is reduced, and copy production is improved when the digital copier 100 is being used.

The registration correction value update process is not performed during warm-up when the registration correction value update process has been performed just prior to entering the preheat mode before the warm-up, even if the digital copier 100 is currently warming up. In this way, the registration correction value update process is not executed when an image forming process has not been performed after the previously executed registration correction value update process, thus avoiding unnecessarily performing the registration correction value update process.

The reliability of the registration correction value is ensured because the registration correction value update process is not executed when there is insufficient residual toner remaining in an image forming unit. Furthermore, the reliability of the registration correction value is increased because the registration correction value update process is performed immediately when new toner has been supplied.

All aspects of the embodiment disclosed above have been described by way of example, but are not limited thereto. The scope of the present invention is specified by the scope of the claims and not by the aforesaid description, and includes all modifications within the scope and meanings equivalent to the scope of the claims, including

What is claimed is:

1. An image forming apparatus comprising:

a plurality of image forming units for respectively forming images on a recording medium;

a receiving unit for receiving input from outside the apparatus;

a registration pattern detecting unit for detecting registration patterns formed by the plurality of image forming units; and a calculating unit including a first timer for measuring the passage of time from the reception of final input by the receiving unit and a second timer for measuring the passage of time from the point the plurality of image forming units stop, said calculating unit being connected with the registration pattern detecting unit and the plurality of image forming unit, said calculating unit determining registration correction values for correcting deviance of the images based on an output from the registration pattern detecting unit and requesting an update of the registration correction values based on a value of the first timer and/or the second timer.

2. An image forming apparatus comprising:

a plurality of image forming units for respectively forming images on a recording medium;

a fixing unit for fusing the images formed on the recording medium to the recording medium;

a fixing temperature detecting unit for detecting a temperature of the fixing unit;

a registration pattern detecting unit for detecting registration patterns formed by the plurality of image forming units;

a receiving unit for receiving input from outside the apparatus; and a calculating unit including a first timer for measuring the passage of time from the reception of a final input by the receiving unit and a second timer for measuring the passage of time from the point the plurality of image forming units stop, the calculating unit determining registration correction values for correcting deviance of the images based on an output from the registration pattern detecting unit and requesting an update of the registration correction value based on at least one of 1) the temperature detected by the fixing temperature detecting unit and 2) a value of the first timer and/or the second timer, wherein the calculating unit does not request an update based on the temperature detected by the fixing temperature unit when an update has already been requested the value of the first timer and/or the second timer.

3. An image forming apparatus comprising:

a plurality of image forming units for respectively forming images on a recording medium;

a remainder detecting unit for detecting an amount of remaining recording media remaining in a recording media accommodating unit;

a registration pattern detecting unit for detecting registration patterns formed by the plurality of image forming units;

a calculating unit connected with the remainder detecting unit and the registration pattern detecting unit, said calculating unit determining a registration correction values for correcting deviance of the images based on an output from the registration pattern detecting unit and requesting an update of the registration correction value when the amount of remaining recording media detected by the remainder detecting unit is less than a predetermined value.

4. An image forming apparatus comprising:

a plurality of image forming units for respectively forming images on a recording medium;

a residual toner detecting unit for detecting the amount of remaining toner accommodated in each of the plurality of image forming units;

a registration pattern detecting unit for detecting registration patterns formed by the plurality of image forming units; and a calculating unit connected with the residual toner detecting unit and the registration pattern detecting unit, the calculating unit determining a registration correction values for correcting deviance of the images based on output from the registration pattern detecting unit and requesting an update of the registration correction values when the amount of remaining toner of at least one among the plurality of image forming units detected by the residual toner detecting unit is in depleted state at less than a predetermined value.

5. In an image forming apparatus that comprises a plurality of image forming units for respectively forming images on a recording medium, a method of updating registration correction values for correcting deviance of the images comprising the steps of:

(1) measuring at least one of a first passage of time from the reception of a final input received from outside the apparatus and a second passage of time from the point the plurality of image forming units stop; and (2) executing, in a case where the measured first passage of time satisfies a first predetermined condition or the measured second passage of time satisfies a second predetermined condition, the following steps (3-1) through (3-3):

(2-1) forming registration patterns by using the plurality of image forming units;

(2-2) detecting the registration patterns; and (2-3) updating the registration correction values based on the detected registration patterns.

6. In an image forming apparatus that comprises a plurality of image forming units for respectively forming images on a recording medium and a fixing unit for fusing the images formed on the recording medium to the recording medium, a method of updating registration correction values for correcting deviance of the images comprising the steps of:

(1) detecting a temperature of said fixing unit;

(2) measuring at least one of a first passage of time from a reception of a final input received from outside the apparatus and a second passage of time from the point the plurality of image forming units stop; and (3) executing, in a case where (a) the detected temperature satisfies a first predetermined condition or (b) the measured first passage of time satisfies a second predetermined condition or the measured second passage of time satisfies a third predetermined condition, the following steps (3-1) through (3-3):

(3-1) forming registration pattern by using the plurality of image forming units;

(3-2) detecting registration patterns formed by the plurality of image forming units; and (3-3) updating the registration correction values based on the detected registration patterns, wherein execution of the steps (3-1) through (3-3) under the condition (a) is inhibited when execution of the steps (3-1) through (3-3) under the condition (b) has been done.

7. In an image forming apparatus that comprises a plurality of image forming units for respectively forming images on a recording medium fed from a recording media accommodating unit, a method of updating registration correction values for correcting deviance of the images comprising the steps of:

(1) detecting an amount of remaining recording media remaining in the recording media accommodating unit; and (2) executing, in a case where the detected amount of remaining recording media is less than a predetermined value, the following steps (2-1) through (2-3):

(2-1) forming registration patterns by using the plurality of image forming units;

(2-2) detecting the registration patterns; and (2-3) updating the registration correction values based on the detected registration patterns.

8. In an image forming apparatus that comprises a plurality of image forming units for respectively forming images on a recording medium, a method of updating registration correction values for correcting deviance of the images comprising the steps of:

(1) detecting an amount of remaining toner accommodated in each of the plurality of image forming units; and (2) executing, in a case where the detected amount of remaining toner of at least one among the plurality of image forming units is less than a predetermined value, the following steps (2-1) through (2-3):

(2-1) forming registration patterns by using the plurality of image forming units;

(2-2) detecting the registration patterns; and (2-3) updating the registration correction values based on the detected registration patterns.

9. A computer-readable medium having stored thereon a plurality of sequences of instructions, said plurality of sequences of instructions including sequences of instructions which, when executed by a processor, cause said processor to perform the steps of:

(1) measuring at least one of a first passage of time from the reception of a final input received from outside an image forming apparatus having a plurality of image forming units for respectively forming images on a recording medium and a second passage of time from the point the plurality of image forming units stop; and (2) executing, in a case where the measured first passage of time satisfies a first predetermined condition or the measured second passage of time satisfies a second predetermined condition, the following steps (3-1) through (3-3):

(2-1) forming registration patterns by using the plurality of image forming units;

(2-2) detecting the registration patterns; and (2-3) updating registration correction values based on the detected registration patterns.

10. A computer-readable medium having stored thereon a plurality of sequences of instructions, said plurality of sequences of instructions including sequences of instructions which, when executed by a processor, cause said processor to perform the steps of:

(1) detecting a temperature of a fixing unit in an image forming apparatus having a plurality of image forming units for respectively forming images on a recording medium;

(2) measuring at least one of a first passage of time from a reception of a final input received from outside the image forming apparatus and a second passage of time from the point the plurality of image forming units stop; and (3) executing, in a case where (a) the detected temperature satisfies a first predetermined condition or (b) the measured first passage of time satisfies a second predetermined condition or the measured second passage of time satisfies a third predetermined condition, the following steps (3-1) through (3-3):

(3-1) forming registration patterns by using the plurality of image forming units;

(3-2) detecting the registration patterns formed by the plurality of image forming units; and (3-3) updating registration correction values based on the detected registration patterns, wherein execution of the steps (3-1) through (3-3) under the condition (a) is inhibited when execution of the steps (3-1) through (3-3) under the condition (b) has been done.

11. A computer-readable medium having stored thereon a plurality of sequences of instructions, said plurality of sequences of instructions including sequences of instructions which, when executed by a processor, cause said processor to perform the steps of:

(1) detecting an amount of remaining recording media remaining in the recording media accommodating unit in an image forming apparatus having a plurality of image forming units for respectively forming images on a recording medium fed from the recording media accommodating unit; and (2) executing, in a case where the detected amount of remaining recording media is less than a predetermined value, the following steps (2-1) through (2-3):

(2-1) forming registration patterns by using the plurality of image forming units;

(2-2) detecting the registration patterns; and (2-3) updating registration correction values based on the detected registration patterns.

12. A computer-readable medium having stored thereon a plurality of sequences of instructions, said plurality of sequences of instructions including sequences of instructions which, when executed by a processor, cause said processor to perform the steps of:

(1) detecting an amount of remaining toner accommodated in each of a plurality of image forming units in an image forming apparatus; and (2) executing, in a case where the detected amount of remaining toner of at least one among the plurality of image forming units is less than a predetermined value, the following steps (2-1) through (2-3):

(2-1) forming registration patterns by using the plurality of image forming units;

(2-2) detecting the registration patterns; and (2-3) updating registration correction values based on the detected registration pattern.

* * * * *